United States Patent [19]

Prible

[11] 4,049,371

[45] Sept. 20, 1977

[54] PIPE INSULATION

[75] Inventor: Glen Virgil Prible, Malvern, Pa.

[73] Assignee: Combustion Engineering, Inc., Windsor, Conn.

[21] Appl. No.: 666,547

[22] Filed: Mar. 15, 1976

[51] Int. Cl.[2] ..... F27B 9/14

[52] U.S. Cl. ..... 432/234; 432/236; 138/149; 138/147

[58] Field of Search ..... 432/233, 234, 235, 236; 138/147, 149

[56] References Cited

U.S. PATENT DOCUMENTS

| | | | |
|---|---|---|---|
| 926,423 | 6/1909 | Kelly | 432/234 |
| 2,435,362 | 2/1948 | Morton | 432/234 |
| 2,884,879 | 5/1959 | Corriston | 432/234 |
| 3,189,371 | 6/1965 | Swan | 138/149 |
| 3,820,947 | 6/1974 | Boto et al. | 432/236 |
| 3,881,864 | 5/1975 | Nicol | 432/234 |

*Primary Examiner*—John J. Camby
*Assistant Examiner*—Henry C. Yuen
*Attorney, Agent, or Firm*—Richard H. Bernelike

[57] ABSTRACT

Pipe insulating units are disclosed which can be slipped radially over the pipe. The units are formed such that two adjacent pieces interlock to form a set which completely surrounds the pipe and which has parallel faces which are abutted by the parallel faces of adjacent sets. The units and sets are then held together by bolting or other means. Each unit comprises a circular piece of insulating material having a hole in the center thus forming an annular disc. This annular disc has a portion of the annulus omitted with this omitted portion having sides which are parallel to each other and which are tangent to the periphery of the hole in the center. The sides of this omitted portion extend outwardly to the periphery of the disc. Formed integrally therewith on one face of the disc is an outwardly extending portion in the area bonded by extensions of the parallel sides of the omitted portion and on the opposite of the center hole from the omitted portion. Two units are placed over the pipe with their outwardly extending portions facing each other and oriented such that the outwardly extending portions will fit into the omitted portions of the other disc when the units are pushed together. A plurality of these sets are placed over the pipe as needed and then bolted or otherwise held together. If desired, ceramic wool fiber may be placed between the pipe and the insulating units so as to form a vibration cushion.

3 Claims, 4 Drawing Figures

PIPE INSULATION

BACKGROUND OF THE INVENTION

The present invention relates to pipe insulation and more particularly to skid pipe insulation. In reheating furnaces for heating metal billets or the like, there are skid rails which support the billets during the heat treating operation. These skid rails are supported by a structural frame-work of water cooled skid support pipes. These skid support pipes are insulated to reduce the pick up of heat from the furnace by the cooling water and thereby save fuel and cooling water. The insulation also improves the life of the skid and the billet surface quality. Insulating skid pipes and skid support pipes has been a problem because the insulating material is subject to vibration and slag which tends to wear the insulation and vibrate it loose. A relatively short service life requires that the furnace be shutdown at frequent intervals for replacement or repair of the insulation.

A number of techniques for insulating these skid pipes have been employed in the past. One such technique is to weld studs to the skid pipes and pack a refractory material over the pipes and around the studs to form a monolithic coating. Another technique is to wrap a wire mesh around the skid pipes and pack the refractory into the mesh. A number of other arrangements have also been used with varying degrees of success.

SUMMARY OF THE INVENTION

An object of the present invention is to provide pipe insulating units which are all identical and which can easily be installed by placing each unit radially over the pipe and then sliding units together to form interlocking sets. These sets abutt each other to enclose the pipe and the units and sets are held in place by one of several means. A vibration cushion may be placed between the insulating units and the pipe.

DESCRIPTION OF THE PREFERRED EMBODIMENT

Figure 1:
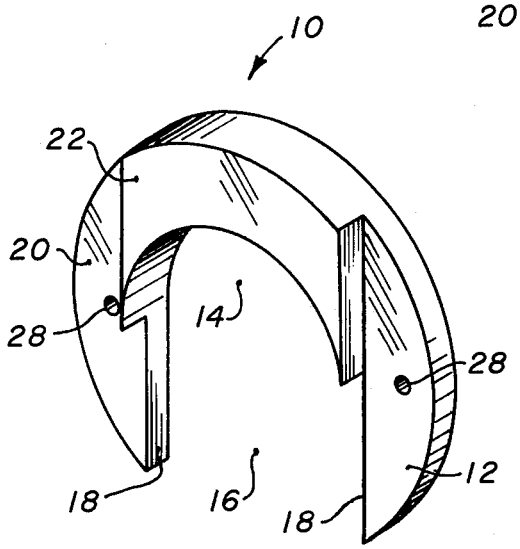
FIG. 1 is a perspective view of one pipe insulating unit according to the present invention.

The present invention involves pipe insulating units which are arranged on the pipe in sets each containing two units. FIG. 1 illustrates in perspective one such unit 10. The unit 10 is basically a circular disc 12 with a circular hole 14 in the center thereof thus forming an annular disc. The portion 16 of the annulus is omitted with this omitted portion having sides 18 which are parallel to each other and which are tangent to the periphery of the hole 14. This forms a generally U-shaped piece which can be slipped radially over a pipe having a diameter somewhat less than the diameter of the hole 14. On the face 20 of the unit 10 is an outwardly extending portion 22 with the boundaries of this portion being defined by the outer periphery of the disc 12, the periphery of the hole 14 and by two parallel lines which are each tangent to the periphery of the hole 14. These lines are extensions of the lines which coincide with the edges 18 such that the portion 22 is on the opposite side of the hole 14 from the omitted portion 16. The thickness of the extending portion 22 is equal to the thickness of the disc 12.

Figure 2:
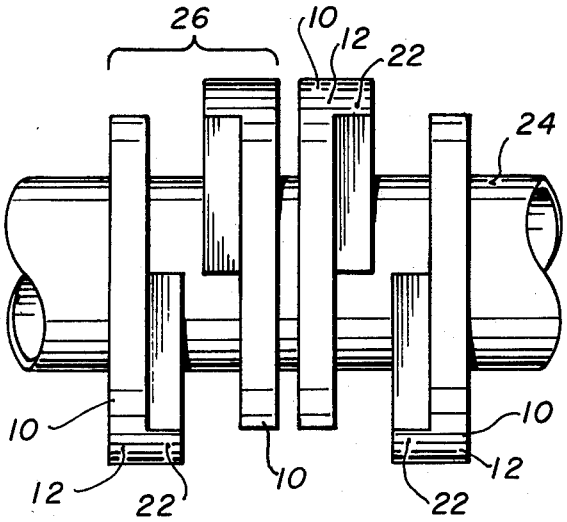
FIG. 2 is a view illustrating a plurality of pipe insulating units according to the present invention installed on a pipe and oriented in preparation for sliding together into interlocking sets.
Figure 3:
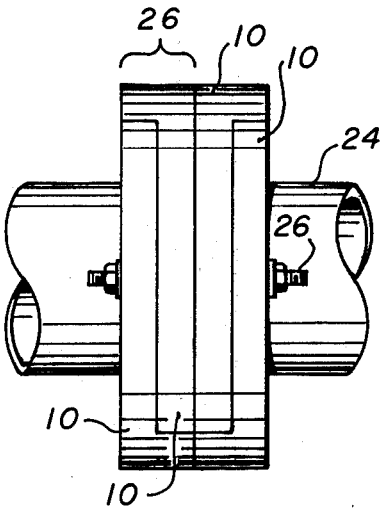
FIG. 3 is a view of the units of FIG. 2 interlocked together into sets.

FIGS. 2 and 3 illustrates how the units 10 are assembled on a pipe 24. The identical units 10 are shipped over the pipe 24 with adjacent units having the extending portion 22 thereof facing in opposite directions. The pairs of units with the extending portions facing each other form sets 26. The units are oriented such that the extending portion 22 of each set are located on opposite sides of the pipe 24 such that the units in each set may be slid axially together whereby the extending portion 22 on each unit fits into the omitted portion 16 on the other unit in the set. The units 10 in their final interlocking position are shown in FIG. 3.

The pipe insulating units may be formed from a variety of material as desired. The preferred material is a high alumina refractory which is formed to shape and then fired. An alternate material would be one such as a bonded ceramic fiber material which is vacuum formed to shape.

Alternative means may be employed to anchor the units and sets in position. The illustrated method involves the use of the nut and bolt arrangement 26 with the bolt being inserted through the holes 28 in the units 10. Another method is to cement the units and sets together with a high refractory cement. This also serves to seal off the joints between the units and sets. Also, a combination of the nuts and bolts and cement may be used.

Figure 4:
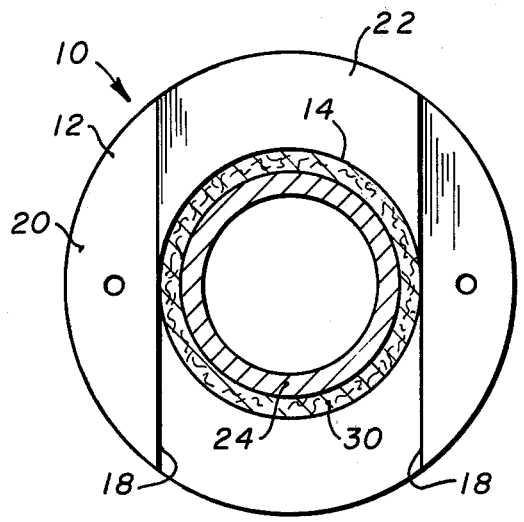
FIG. 4 is an optional arrangement of the units and sets on the pipe.

FIG. 4 is an end view of a unit 10 over a pipe 24 with a layer of ceramic wool fiber 30 or similar refractory material between the pipe 24 and the insulating unit 10. This layer 30 serves as a cushion to reduce the transmission of mechanical shocks to the refractory shapes.

What is claimed is:

1. Pipe insulation comprising a plurality of units, each unit comprising:

a. a generally circular piece of insulating material having a generally circular hole in the center thereof thereby forming an annular disc and having a portion of the annulus of the disc omitted, said omitted portion having sides which are parallel to each other and which are tangent to the periphery of said hole and which extend outwardly to the periphery of said disc, b. a piece of insulating material integral with and extending outwardly from one face of said disc in the area bonded by extensions of the parallel sides of said omitted portion and on the opposite side of said hole from said omitted portion, c. the thickness of said disc and said outwardly extending piece on the face thereof being of equal thickness, and d. said plurality of units being positioned on a pipe in pairs such that each unit of each pair has said outwardly extending piece extending into said omitted portion of the other unit of said pair and including means for holding said units and pairs in position.

2. Pipe insulation as recited in claim 1 wherein said means for holding said units and pairs in position comprises bolts extending through said units and pairs parallel to said pipe.

3. Pipe insulation as recited in claim 1 wherein said means for holding said units and pairs in position comprises cement between said units and pairs.

* * * * *